US006059443A

United States Patent [19]

Casey

[11] Patent Number: 6,059,443

[45] Date of Patent: May 9, 2000

[54] METHOD AND SYSTEM FOR STORING AND MIXING TWO SUBSTANCES IN A CONTAINER

[76] Inventor: Theodore Casey, 7547 Overdale Dr., Dallas, Tex. 75240-2831

[21] Appl. No.: 09/008,166

[22] Filed: Jan. 16, 1998

[51] Int. Cl.[7] ..... A47J 43/27; B65D 25/08

[52] U.S. Cl. ..... 366/130; 206/219; 215/DIG. 8

[58] Field of Search ..... 366/130; 206/219, 206/221, 222; 215/DIG. 3, DIG. 8, 6

[56] References Cited

U.S. PATENT DOCUMENTS

| | | | |
|---|---|---|---|
| 1,661,336 | 3/1928 | Katz | 366/130 |
| 1,748,483 | 2/1930 | Hyde | 366/130 |
| 2,619,088 | 11/1952 | Saffir | 215/DIG. 8 |
| 2,793,776 | 5/1957 | Lipari | 206/222 |
| 3,407,922 | 10/1968 | Palmer | 206/219 |
| 3,613,955 | 10/1971 | Wetherell, Jr. | 206/221 |
| 4,121,772 | 10/1978 | Cronan | 206/219 |
| 4,152,378 | 5/1979 | Vcelka et al. | 215/DIG. 3 |
| 4,410,085 | 10/1983 | Beneziat et al. | 206/219 |
| 4,818,114 | 4/1989 | Ghavi | 366/130 |
| 5,370,222 | 12/1994 | Steigerwald et al. | 206/222 |
| 5,419,429 | 5/1995 | Zimmerman et al. | 215/DIG. 8 |
| 5,547,275 | 8/1996 | Lillelund et al. | 366/130 |
| 5,660,867 | 8/1997 | Reynolds et al. | 206/222 |

*Primary Examiner*—Tony G. Soohoo
*Attorney, Agent, or Firm*—Smith & Danamrai, P.C.

[57] ABSTRACT

A method and apparatus for separately storing a first substance and a second substance, and mixing the substances at the time of usage of a product comprising a mixture of the first substance and the second substance. A mixing container includes a main body that stores a first substance, the main body having a lip defining an upper opening. A storage repository stores a second substance. A removable seal is placed upon the top of the storage repository, preventing the exit of the second substance from the storage repository. When a user desires to mix the first and second substance, he removes the seal and secures a cap to the top of the mixing container. The cap, when secured to the top of the main body and covering the upper opening, provides a void above the lip of the mixing container for mixing of the two substances. When the user agitates the mixing container, the first and second substances are mixed together.

5 Claims, 4 Drawing Sheets

METHOD AND SYSTEM FOR STORING AND MIXING TWO SUBSTANCES IN A CONTAINER

BACKGROUND OF THE INVENTION

1. Technical Field of the Invention

This invention relates to containers, and more particularly, to a mixing container having separate storage compartments for two ingredients.

2. Description of Related Art

Many mixtures and solutions require that the ingredients be mixed at the time, or shortly before, the mixture or solution is utilized for its intended purpose. This is true in the areas of chemistry, pharmaceuticals, and even certain nutritional sport drinks. For example, there are numerous sports drinks having a liquid ingredient and a powder ingredient which includes chemicals which have a short shelve life when mixed with a liquid. The powder must be kept dry until it is mixed with the liquid at the time of consumption. Therefore, during manufacture, shipping, and storage, the powder must be kept separate from the liquid, but in a readily available location.

Prior art systems for shipping and storing such ingredients have included bottles for the liquid ingredient having means for securing a separate container to the outside of the bottle for the powder ingredient. Additional systems have incorporated separate storage compartments in the closure or cap of the bottle for storing the powder ingredient. For example, U.S. Pat. No. 4,221,291 to Hunt (Hunt) and U.S. Pat. No. 5,038,951 to Rizzardi (Rizzardi) disclose a type of container in the shape of a bottle, can, or the like wherein a frangible member is adapted to be severed or ruptured by the depression of a plunger so as to disperse a material stored in a compartment in the neck of the bottle or container into a liquid which is located in the container. However, severance of the frangible member is caused by relatively complex and cumbersome mechanisms or actuators in these prior art patents, making them expensive to manufacture.

In addition, U.S. Pat. No. 4,793,475 to Itzel (Itzel) and U.S. Pat. No. 5,465,835 to Schumacher et al. (Schumacher) disclose closure caps for two-component packaging systems in which a liquid component is stored in a container such as a bottle or can, and a powder or second liquid component is stored in a reservoir in the closure cap. Each of these patents releases the second component by twisting the closure cap sharply to break the reservoir along a weakened line, thereby dispersing the second component from the reservoir into the liquid which is located in the container. In these prior art patents, however, breaking of the reservoir is also caused by relatively complex and cumbersome mechanisms or actuators making them expensive to manufacture.

Finally, U.S. Pat. No. 5,114,011 to Robbins, III (Robbins) discloses a container assembly which may hold a liquid in a container and a powder or second liquid in an additive cup detachably supported within the neck or other discharge opening of the container. After a cap is removed from the discharge opening, the additive cup is removed by the user and a seal is removed therefrom. The contents of the additive cup are then poured by the user into the container. The additive cup is then inverted and mounted over the discharge opening to form a dispenser of the resultant mixture in the container. However, Robbins requires that the user remove the additive cup and pour the second component into the container. This may be difficult for containers with narrow discharge openings. In addition, in some uses for the container, the additive may be toxic, and the requirement to manually pour the additive into the container may be hazardous. In other uses, a more sterile environment may be desired.

Review of each of the foregoing references reveals no disclosure or suggestion of a system or method such as that described and claimed herein.

SUMMARY OF THE INVENTION

In one aspect, the present invention is a mixing container. The mixing container includes a main body that stores a liquid substance. The main body has a neck and a lip at the top of the neck defining an upper opening. The mixing container also includes a storage repository that stores a mixing substance. The storage repository has an open upper end and is sized to fit in the neck of the bottle. Additionally, the mixing container includes a plurality of support arms connected to the upper end of the storage repository and the lip. The support arms support the storage repository in the neck and form a plurality of apertures between the support arms, the storage repository, and the lip. A cap is fastened on the neck and forms a water-tight seal. The cap has a top surface and a side. The side has an inside height such that a void is formed between the lip and the top surface of the cap when the cap is fastened on the neck. The mixing of the liquid substance and the mixing substance is achieved in the void by inverting and shaking the container. In addition, the mixing is enhanced by vortices generated by the liquid substance flowing across the support arms.

In another aspect, the present invention is a mixing container. The mixing container includes means for storing a liquid substance, means within the liquid storing means for storing a powder separately from the liquid prior to a desired mixing time, and means for opening the liquid storing means and the powder storing means at the desired mixing time. In addition, the mixing container includes means for creating a mixing void around an opening of the powder storing means and means for creating at least one liquid vortex in the mixing void.

In still another aspect, the present invention is a mixing container which includes a main body that stores a first substance, the main body having a lip defining an upper opening. A storage repository that stores a second substance is located at the upper opening of the main body. The storage repository is secured within the upper opening of the main body by a plurality of supporting arms. The mixing container includes a cap placed upon the lip of the main body. The cap provides a void above the lip of the main body, thereby facilitating in the mixing of the first and second substances when the main body is agitated.

In another aspect, the present invention is a method of separately storing a first substance and a second substance, and mixing the substances at the time of usage of a product comprising a mixture of the first substance and the second substance. The method begins by placing the first substance in a main body having a lip defining an upper opening, and placing the second substance in a storage repository located within the upper opening of the main body. This is followed by sealing the storage repository with a removable seal. This is followed by removing the seal from the storage repository at the time of usage of the product. Next, a cap is placed upon the main body, thereby creating a void above the lip of the main body and covering the upper opening of the main body. The main body is then agitated to mix the first and second substances.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
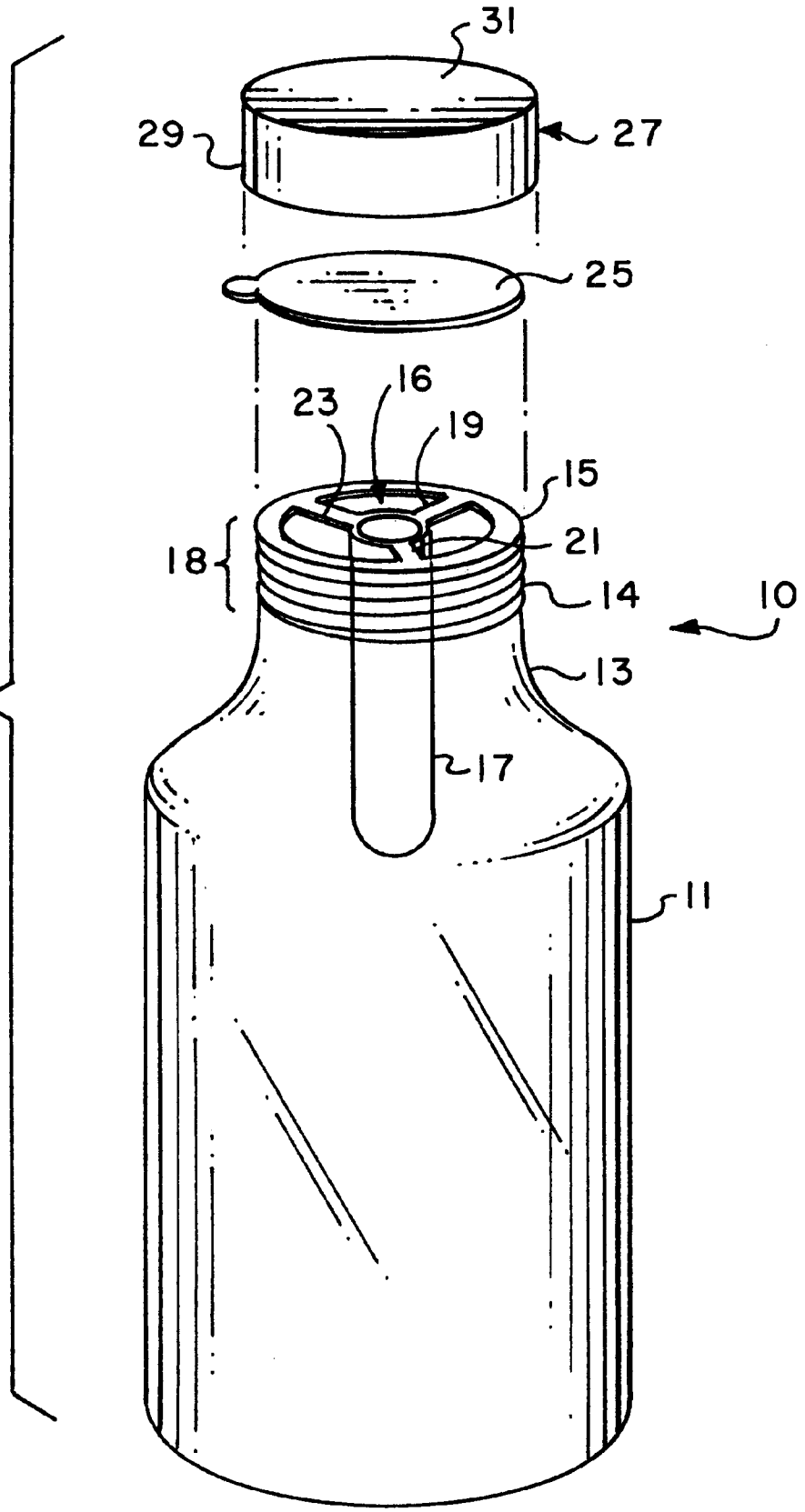
FIG. 1 is an exploded perspective view of the preferred embodiment of the mixing container of the present invention.

FIG. 1 is an exploded perspective view of the preferred embodiment of the mixing container 10 of the present invention. The mixing container 10 includes a main body 11 having a neck 13, and a lip 15 defining an opening 16. The neck 13 includes threads 14 which have an overall vertical height 18. A storage repository 17 is supported upon the lip 15 by support arms 19–23 which are integrally attached to the lip 15 and the storage repository 17. The storage repository 17 must be smaller than the circumference of the lip 15, thus requiring the supporting arms 19–23 to maintain the storage repository 17 in position. The supporting arms 19–23 depicted in FIG. 1 are exemplary only, however, any type and number of supports may be used to hold the storage repository 17 in position as long as the opening 16 remains relatively unobstructed.

In the preferred embodiment of the present invention, the storage repository 17 is placed in the center of the opening 16. Additionally, a plurality of support arms are used to support the storage repository 17. The support arms, the centered storage repository 17, and the lip 15 form a plurality of apertures which are spaced annularly about the storage repository 17, and through which a liquid may exit from the main body 11. The support arms 19–23 act as "vortex generators" which create vortices when the liquid pass through the apertures, thereby enhancing mixing of the two substances. The storage repository 17 may be any shape, but must not extend vertically above the lip 15. The storage repository 17 may be constructed of any of several different materials, such as plastic, glass, and stainless steel. Likewise, any shape is acceptable for the main body (such as a cylindrical can) as long as the storage repository 17 can be held within the main body 11 without extending beyond the lip 15.

A removable seal 25 seals the storage repository 17 and the opening 16 during shipping, handling and storage. In addition to preventing any outside contaminants from entering the container, the seal 25 prevents any liquid in the main body 11 from coming in contact with or mixing with any substance stored in the storage repository 17. The seal may be a foil sheet, a plastic disk, or any other type of water-tight and air-tight sealer. The seal may be affixed to the storage repository 17 with a suitable adhesive, mechanical clamping mechanism, or other means allowing a user to easily remove the seal 25. In an alternate embodiment, the seal 25 may only cover the storage repository 17.

A cap 27 covers the opening 16 during shipping and storage. The cap 27 includes a side 29 and a top surface 31. The interior side of side 29 has threads (not shown) which screw onto the threads 14 on the neck 13 of the main body 11. The depth of the interior side of the cap is greater than the overall vertical height of the threads 14. Therefore, when completely seated upon the main body 11, the side 29 extends a measurable distance above the lip 15, forming a void. The threads on the cap 27 and the main body 11 are exemplary only in describing a means for securing the cap 27 to the main body 11, other means may be used to secure the cap 27 onto the main body 11. For example an O-ring device may be utilized to fasten the cap 27 to the main body 11.

Figure 2:
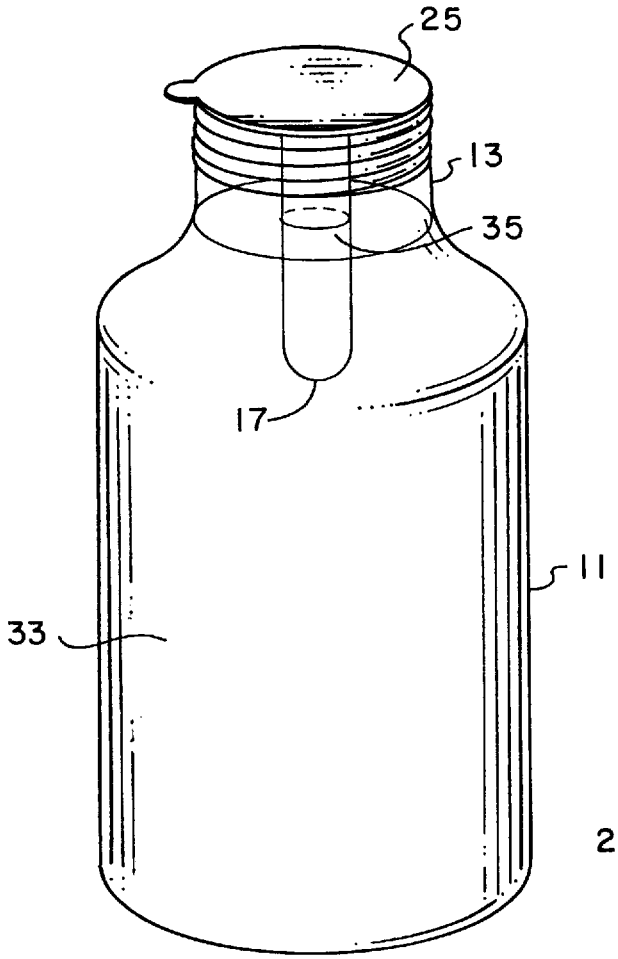
FIG. 2 is a perspective view of the preferred embodiment of the mixing container of the present invention with the storage repository covered by a seal on the lip of the mixing container.

FIG. 2 is a perspective view of the preferred embodiment of the mixing container 10 of the present invention with the storage repository 17 covered by the seal 25 on the lip 15 of the mixing container. In operation, the main body 11 is filled with a first substance 33 which may be, for example, a liquid or a powder. The storage repository 17 is filled with a second substance 35 which may also be a liquid or a powder. The main body 11 and the storage repository 17 do not have to be filled at the same time or same place. The storage repository 17 is sealed with the seal 25. The sealed storage repository 17 is held in place by supporting arms 19–23. The cap 27 is then placed on the mixing container for shipping and storage.

Figure 3:
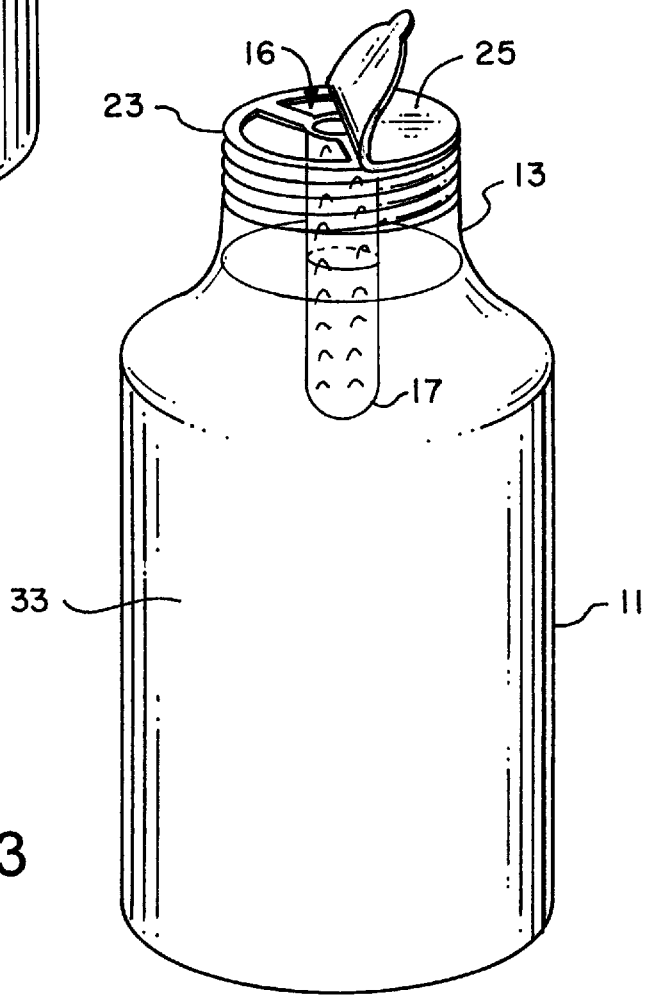
FIG. 3 is a perspective view of the preferred embodiment of the mixing container of the present invention showing the seal being removed from the lip of the mixing container.

FIG. 3 is a perspective view of the preferred embodiment of the mixing container 10 of the present invention showing the seal 25 being removed from the lip 15 of the mixing container. When a user desires to mix the first substance 33 in the main body 11 with the second substance 35 in the storage repository 17, the cap 27 and the seal 25 are removed, thereby opening the storage repository 17.

Figure 4:
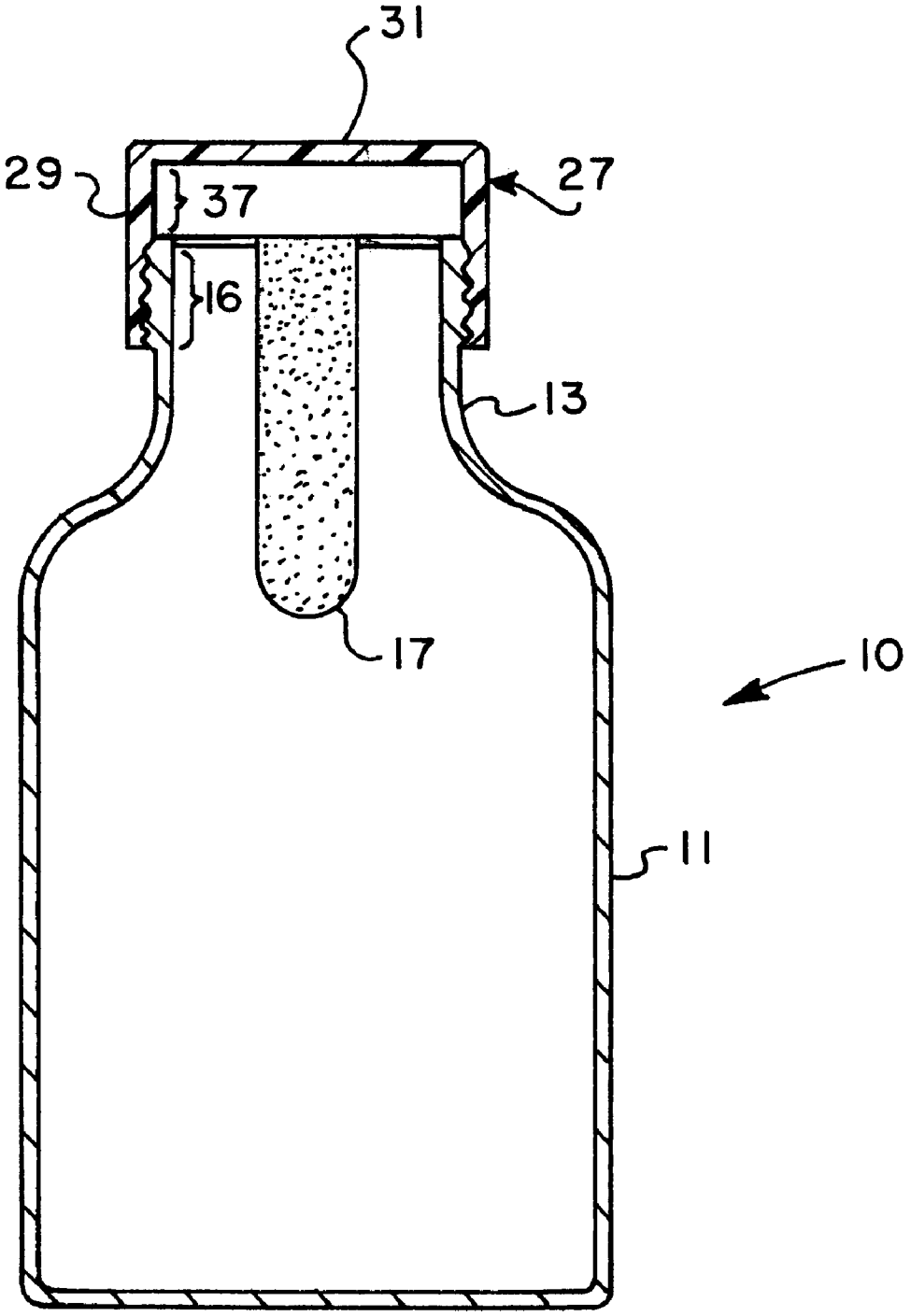
FIG. 4 is a front elevational, cross-sectional view of the preferred embodiment of the mixing container of the present invention with the seal removed and the cap secured over the top of the mixing container.

FIG. 4 is a front elevational, cross-sectional view of the preferred embodiment of the mixing container 10 of the present invention with the seal 25 removed and the cap 27 secured over the top of the mixing container 10. A distance 37 in which the side 29 extends above the lip 15 must be great enough to allow a substance present within the storage repository 17 to exit the storage repository when the seal 25 is removed. When inverted and shaken, liquid from the main body and powder from the storage repository enter the void and begin to mix. As the liquid flows around the support arms 19–23 and edge of the storage repository 17, vortices are generated which enhance mixing and act to draw the powder out of the storage repository 17. The support arms 19–23 acts as "vortex generators" when liquid from the main body 11 pass through the apertures created by the support arms 19–23.

Figure 5:
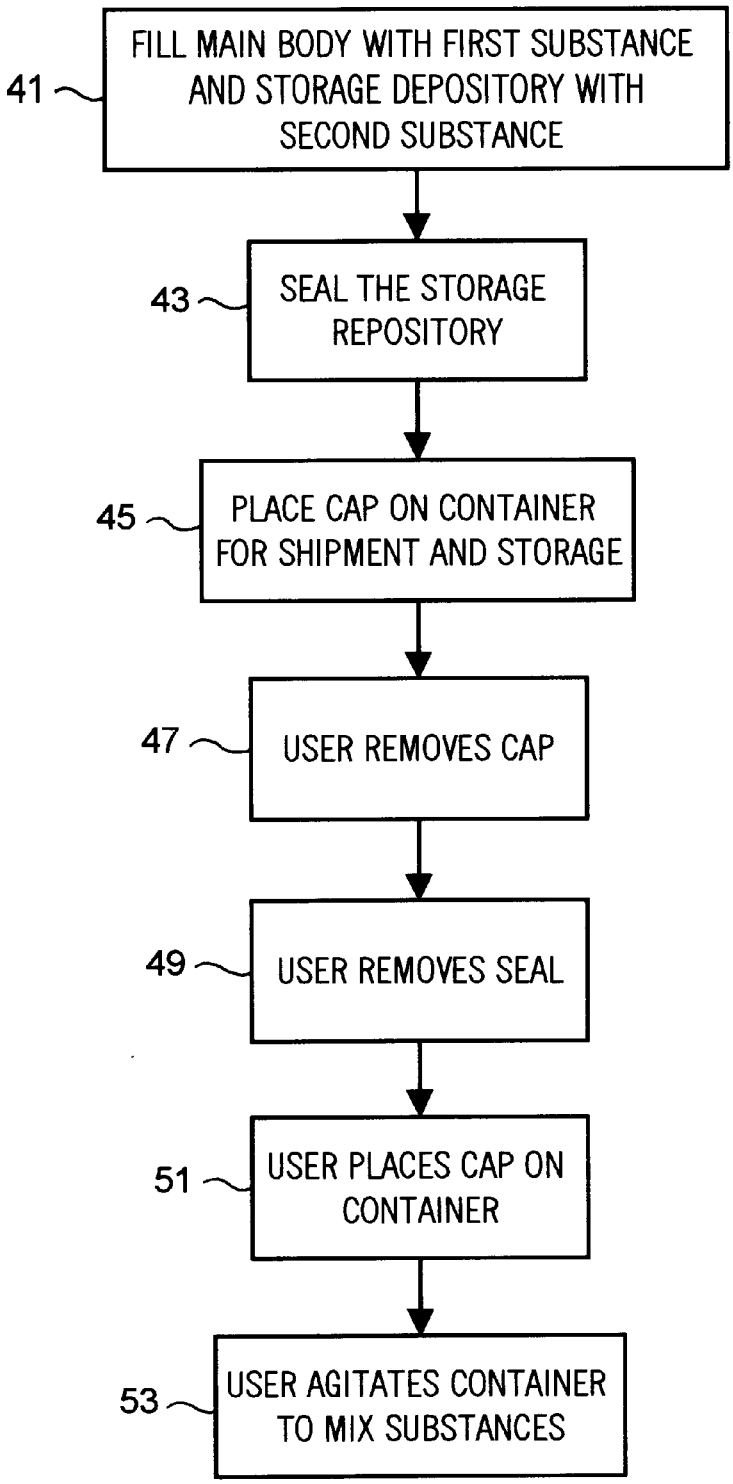
FIG. 5 is a flow chart illustrating the steps of the method of the present invention.

FIG. 5 is a flow chart illustrating the steps of the method of the present invention. In step 41, the main body 11 is filled with the first substance 33 and the storage repository 17 is filled with the second substance 35. The main body 11 and the storage repository 17 do not have to be filled at the same time or same place. At step 43, the storage repository 17 is sealed with the seal 25. At 45, the cap 27 is placed on the mixing container 10 for shipping and storage.

Steps 47–53 illustrate the mixing of the first and second substances. At step 47, a user removes the cap 27, thereby exposing the seal 25. At step 49, the user removes the seal 25, opening the storage repository 17. At step 51, the user replaces the cap on the mixing container 10. The cap 27 must be attached securely to prevent any of the first substance 33 or the second substance 35 from exiting mixing container 10. In addition, the cap 27 must be seated in such a fashion to create a void between the top of the lip 15 and the top surface 31. In step 53, the user agitates the mixing container (e.g., vigorous shake mixing container and invert mixing container) to mix the first and second substances.

The use of this invention has many advantages over any prior art. First, the mixing container 10 is simple to use. The mixing container 10 does not involve any complicated process to mix the two ingredients. Second, the mixing container 10 is not expensive to manufacture as compared to the manufacture of the complicated devices found in prior art inventions. Finally, the mixing container 10 provides an effective and efficient way to store and mix two ingredients in one container.

It is thus believed that the operation and construction of the present invention will be apparent from the foregoing description. While the method and apparatus shown and described has been characterized as being preferred, it will be readily apparent that various changes and modifications could be made therein without departing from the spirit and scope of the invention as defined in the following claims.

What is claimed is:

1. A mixing container comprising:

a main body that stores a liquid substance, the main body having a neck and a lip at the top of the neck defining an upper opening;

a storage repository that stores a mixing substance, the storage repository having an open upper end and being sized to fit in the neck of the bottle;

a plurality of support arms connected to the upper end of the storage repository and the lip, the support arms supporting the storage repository in the neck and forming a plurality of apertures between the support arms, the storage repository, and the lip; and a cap that forms a water-tight seal when fastened on the neck, said cap having a top surface and a side, the side having an inside height such that a void is formed between the lip and the top surface of the cap when the cap is fastened on the neck;

wherein the lip, the upper end of the storage repository, and the support arms are planarly aligned, and the container further comprises a removable seal which is adhered to the lip and the upper end of the storage repository to prevent mixing prior to a desired time;

whereby mixing of the liquid substance and the mixing substance is achieved in the void by inverting and shaking the container, the mixing being enhanced by vortices generated by the liquid substance flowing across the support arms.

2. A mixing container comprising:

a main body that stores a first substance, the main body having a lip defining an upper opening;

a storage repository that stores a second substance, the storage repository being sized to fit within the upper opening of the main body;

a removable seal which seals the storage repository, thereby preventing the mixing of the first and second substances until the seal is removed;

a supporting means for securing the storage repository within the upper opening of the main body, wherein the supporting means is a plurality of supporting arms surrounding the lip of the main body, the plurality of supporting arms generating vortices when agitating the main body, facilitating in mixing the first and second substances; and a cap placed upon the lip of the main body, the cap providing a void above the lip to facilitate mixing of the first and second substances;

whereby agitating the main body causes the first and second substances to be mixed.

3. The mixing container of claim 2 wherein:

the main body is a bottle having a neck with an upper end, and the upper opening is at the upper end of the neck; and the seal is a foil sheet which is affixed to the storage repository with an adhesive.

4. A method of separately storing a first substance and a second substance, and mixing the substances at the time of usage of a product comprising a mixture of the first substance and the second substance, the method comprising the steps of:

placing the first substance in a main body having a lip defining an upper opening;

placing the second substance in a storage repository located within the upper opening of the main body;

sealing the storage repository with a removable seal;

removing the seal from the storage repository at the time of usage of the product;

placing a cap upon the main body, the cap creating a void above the lip of the main body, thereby covering the upper opening of the main body; and agitating the main body to mix the first and second substances.

5. The method of storing and mixing first and second substances of claim 4 further comprising, after the step of sealing the storage repository with a removable seal, the steps:

of placing a cap on the main body for the storage and transportation of the first substance and the second substance; and removing the cap to expose the seal at the time of usage of the product.

* * * * *